US011781331B1

(12) United States Patent
Toomey

(10) Patent No.: US 11,781,331 B1
(45) Date of Patent: Oct. 10, 2023

(54) PORTABLE WATER PARK

(71) Applicant: Joseph Toomey, Pittsburgh, PA (US)

(72) Inventor: Joseph Toomey, Pittsburgh, PA (US)

( * ) Notice: Subject to any disclaimer, the term of this patent is extended or adjusted under 35 U.S.C. 154(b) by 258 days.

(21) Appl. No.: 16/910,126

(22) Filed: Jun. 24, 2020

Related U.S. Application Data

(60) Provisional application No. 62/866,055, filed on Jun. 25, 2019.

(51) Int. Cl.

| | |
|---|---|
| ***E04H 4/00*** | (2006.01) |
| ***E04H 4/14*** | (2006.01) |
| ***A63G 31/00*** | (2006.01) |
| ***E01C 13/02*** | (2006.01) |
| ***E01C 13/04*** | (2006.01) |

(52) U.S. Cl.
CPC ..... *E04H 4/0018* (2013.01); *A63G 31/00* (2013.01); *A63G 31/007* (2013.01); *E01C 13/02* (2013.01); *E01C 13/04* (2013.01); *E04H 4/14* (2013.01); *E04H 2004/0068* (2013.01)

(58) Field of Classification Search
CPC . E04H 4/0018; E04H 4/14; E04H 2004/0068; A63G 31/00; A63G 31/007; E01C 13/02; E01C 13/04
See application file for complete search history.

(56) References Cited

U.S. PATENT DOCUMENTS 877,766 A 1/1908 Greilick
4,727,697 A * 3/1988 Vaux ..... E04F 15/22 428/116
5,769,725 A * 6/1998 Ogden ..... G09B 9/14 472/59
6,319,139 B1 * 11/2001 Tracy ..... A63B 71/02 472/117
6,739,979 B2 * 5/2004 Tracy ..... B05B 17/08 472/117
7,980,914 B1 * 7/2011 Blais ..... A63G 31/007 4/488
8,550,928 B2 * 10/2013 Hamelin ..... A63G 31/007 239/17
8,656,662 B2 2/2014 Moller, Jr. et al.
(Continued)

OTHER PUBLICATIONS

Instasplash Splash pads, Modular Design—For Ultimate Flexibility and Portability, http://www.instasplash.com/index.html, dated Mar. 19, 2019, 1 page.

*Primary Examiner* — Michael D Dennis
(74) *Attorney, Agent, or Firm* — Thomas M. Joseph, Esq.

(57) ABSTRACT

A splash pad has a plurality of interlocking pallet assembly modules with each pallet assembly module having a supporting body and a water permeable layer and each water permeable layer connects to at least one adjacent water permeable layer to form a continuous water permeable walking surface. At least one tubular dispenser has at least one nozzle extending through the splash pad continuous water permeable walking surface. A pumping station has at least one pump and at least one water intake device. The splash pad, the tubular dispenser, and the pumping station inserts into a recession having water therein. The water intake device provides water from the recession to the at least one pump, so that the pump can drive water through the tubular dispenser to project through the nozzle onto the splash pad continuous water permeable walking surface.

11 Claims, 9 Drawing Sheets

(56) References Cited

U.S. PATENT DOCUMENTS

| | | | | |
|---|---|---|---|---|
| 9,216,362 | B2 | 12/2015 | Hague et al. | |
| 9,334,639 | B2 | 5/2016 | Lenko | |
| 9,604,151 | B2 | 3/2017 | Decaro et al. | |
| 2005/0072115 | A1* | 4/2005 | Chappell | E02D 27/32 52/782.1 |
| 2007/0054745 | A1* | 3/2007 | Henry | A63G 3/00 472/13 |
| 2007/0105635 | A1 | 5/2007 | Mosher | |
| 2011/0131719 | A1* | 6/2011 | Rudenberg | E04H 4/0056 4/495 |

* cited by examiner

PORTABLE WATER PARK

CROSS REFERENCE TO RELATED APPLICATION

This application claims the benefit under 35 U.S.C. § 119(e) of U.S. Provisional Application No. 62/866,055 entitled "PORTABLE WATER PARK" filed Jun. 25, 2019, which is incorporated herein by reference.

BACKGROUND

Water recreation has been popular for a long time, which lead to the development of public pools and water parks that provide fun and recreation to users. There has particularly been significant growth in the development of such facilities by communities or entities within communities. In implementing such facilities, it is desirable to provide the facility with attractions or a design which is appealing to people, which itself has led to the development of theme-oriented water parks and attractions.

These theme-oriented parks typically include multiple raised structures upon which water nozzles are mounted for emitting a discharge stream of water on the park users. Conventional water park structures can include large, interactive play elements and structures. While such play structures provide substantial entertainment, the size and overall cost of conventional water park structures make them impractical for installation in smaller water parks or locations. Moreover, these large structures are immobile.

Over the past twenty-five years, a special type of water park has been developed for cities, amusement parks, hotels, and other facilities catering to family recreation and leisure. These water parks include zero-depth aquatic or water play area installations that are generally referred to as splash pads, spray parks, spray grounds and wet decks. These play area installations typically include water dispensing elements and structure such as, but not limited to, water cannons, spray arches, ground sprays, and the like.

While these structures are usually smaller and less expensive, as compared to conventional water parks, these structures usually require relatively complex permanent structural installations. Additionally, these splash pad structures typically circulate massive amounts of water through these water dispensing elements onto a playing surface, which must be drained by conventional drainage structures. Unfortunately, those structures are subject to clogging and to blockage. In some instances, these structures can have slippery surfaces that create the need for safety measures due to the risk of injury associated with slipping and falling onto hard surfaces. For these reasons, there is a need for an improved water park and/or splash pad.

SUMMARY

The following summary is provided to introduce a selection of concepts in a simplified form that are further described below in the detailed description. This summary is not intended to identify key features or essential features of the claimed subject matter, nor is it intended to be used to limit the scope of the claimed subject matter.

In various implementations, a module for a water amusement device is provided. A pallet assembly has an upper deck, a base, and at least one reinforcement member positioned between the upper deck and the base. A water permeable layer is positioned over the pallet assembly upper deck having a walking surface thereon.

In other implementations, a portable waterpark is provided. A splash pad has a plurality of interlocking pallet assembly modules with each pallet assembly module having a supporting body and a water permeable layer and each water permeable layer connects to at least one adjacent water permeable layer to form a continuous water permeable walking surface. At least one tubular dispenser has at least one nozzle extending through the splash pad continuous water permeable walking surface. A pumping station has at least one pump and at least one water intake device. The splash pad, the tubular dispenser, and the pumping station inserts into a recession having water therein. The water intake device provides water from the recession to the at least one pump, so that the pump can drive water through the tubular dispenser to project through the nozzle onto the splash pad continuous water permeable walking surface.

In yet other implementations, a method for circulating water through a portable waterpark is provided. The water is drawn from a recession through a water intake device with a pump to a tubular dispenser having a nozzle extending therefrom. The water is sprayed from the nozzle onto a continuous water permeable walking surface formed from a plurality of interlocking pallet assembly modules, so that the water permeates the continuous water permeable walking surface and flows through the plurality of interlocking pallet assembly modules to collect within the recession.

In other implementations, a portable waterpark has a pumping station with a pump and a shallow water intake for coupling to the pump. The shallow water intake includes an essentially flat, essentially cylindrical, tubular head for inserting into water. A tubular connecting member is in fluid communication with the pump. The essentially flat, essentially cylindrical, tubular head connects to the tubular connecting member so that the pump can draw water into the essentially flat, essentially cylindrical, tubular head through the tubular connecting member.

These and other features and advantages will be apparent from a reading of the following detailed description and a review of the appended drawings. It is to be understood that the foregoing summary, the following detailed description and the appended drawings are explanatory only and are not restrictive of various aspects as claimed.

DETAILED DESCRIPTION

The subject disclosure is directed to a portable water park and, more particularly, to a portable water park that includes a lightweight structure that utilizes a no slip water permeable walking surface positioned on a modular assembly that rests within a shallow recession to facilitate the circulation of water therethrough. The disclosed structure utilizes a pumping system that does not require massive water storage tanks or conventional drains that can be clogged with leaves or other debris. Additionally, the portable water park can be implemented with no excavation.

The detailed description provided below in connection with the appended drawings is intended as a description of examples and is not intended to represent the only forms in which the present examples can be constructed or utilized. The description sets forth functions of the examples and sequences of steps for constructing and operating the examples. However, the same or equivalent functions and sequences can be accomplished by different examples.

References to "one embodiment," "an embodiment," "an example embodiment," "one implementation," "an implementation," "one example," "an example" and the like, indicate that the described embodiment, implementation or example can include a particular feature, structure or characteristic, but every embodiment, implementation or example can not necessarily include the particular feature, structure or characteristic. Moreover, such phrases are not necessarily referring to the same embodiment, implementation or example. Further, when a particular feature, structure or characteristic is described in connection with an embodiment, implementation or example, it is to be appreciated that such feature, structure or characteristic can be implemented in connection with other embodiments, implementations or examples whether or not explicitly described.

Numerous specific details are set forth in order to provide a thorough understanding of one or more embodiments of the described subject matter. It is to be appreciated, however, that such embodiments can be practiced without these specific details.

Various features of the subject disclosure are now described in more detail with reference to the drawings, wherein like numerals generally refer to like or corresponding elements throughout. The drawings and detailed description are not intended to limit the claimed subject matter to the particular form described. Rather, the intention is to cover all modifications, equivalents and alternatives falling within the spirit and scope of the claimed subject matter.

Figure 1:
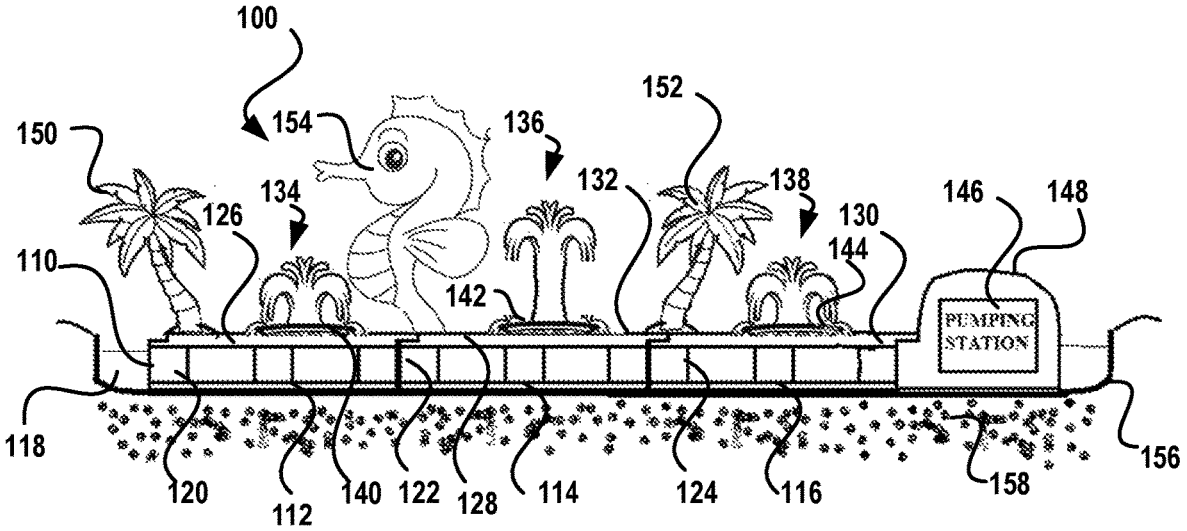
FIG. 1 is a side view in cross section of a portable water park in accordance with the subject matter of this disclosure.

Referring now to FIG. 1, there is shown a portable waterpark, generally designated by the numeral 100, that has various recreational functions. The waterpark 100 is modular in design having a water amusement device or splash pad 110 formed from a plurality of interlocking plastic substructures in the form of pallet assembly modules 112-116 that are positioned within a shallow recession 118. The pallet assembly modules 112-116 include supporting bodies 120-124 and water permeable layers 126-130 positioned thereon. The pallet assembly modules 112-116 can be any suitable plastic substructure.

The pallet assembly modules 112-118 are aligned in predetermined relation abutting one another with the adjacent pallet assembly modules 112-118 connecting to one another for stability within the shallow recession 118. The water permeable layers 126-130 are aligned vertically to form an essentially flat, continuous water permeable walking surface 132.

The continuous water permeable walking surface 132 includes a plurality of tubular dispensers 134-138 embedded within the pallet assembly modules 112-118 and having nozzles 140-144 extending through the water permeable layers 126-130. A pumping station 146 is positioned within shallow recession 118 in fluid communication with the plurality of tubular dispensers 134-138 to pump water through the nozzles 140-144. The pumping station 146 can be concealed by an artificial rock structure 148.

In operation, the pumping station 146 drives water through the nozzles 140-144 onto the continuous water permeable walking surface 132. The water permeates through the continuous water permeable walking surface 132 and the supporting bodies 120-124 with the assistance of gravity. The water collects within the shallow recession 118 for recirculation by the pumping station 146.

As shown in FIG. 1, the continuous water permeable walking surface 132 includes a plurality of amusement features 150-154 positioned thereon. The amusement features 150-154 are three-dimensional objects that can have various predetermined configurations that correspond to animals, plants, and other similar objects. The predetermined configurations can include geometric shapes, organic shapes, inorganic (i.e., abstract shapes), or composite shapes that are combination of two or more of these shape classifications. In this exemplary embodiment, the amusement features 150-152 are shaped like palm trees, and the amusement feature 154 is shaped like a seahorse.

Similarly, the tubular dispensers 134-138 can have various predetermined configurations, such as geometric shapes, organic shapes, inorganic (i.e., abstract shapes), or composite shapes that are combination of two or more of these shape classifications. In this exemplary embodiment, the tubular dispensers 134-138 are fountains with conventional fountain shapes.

The water park 100 is portable because the splash pad 110 is constructed of lightweight interlocking pallet assembly modules 112-116 that can be assembled and disassembled with relative ease. The interlocking pallet assembly modules 112-116 can be connected to one another with conventional fasteners and/or fastening mechanisms.

The splash pad 110 can be assembled within the shallow recession 118, which can serve as a water repository that replaces the water tanks that are used in conventional water parks. The recession 118 can include a tank 156 that is formed from rigid, semi-rigid, or flexible materials. In some embodiments, the tank 156 is placed on a sand layer 158 that ensure that the continuous water permeable walking surface 132 is essentially flat and level. In some alternative embodiments, the recession 118 can be lined with a flexible membrane material that replaces the tank 156.

The dimensions of the water park 100 are not critical. In some embodiments, the recession 118 has a depth of six inches or less to reduce the risk of slipping when a user steps onto the continuous water permeable walking surface 132. This is in contrast to conventional splash pad structures that are raised eight inches or more above the ground. In other embodiments, the dimension of recession 118 is predetermined to ensure that the continuous water permeable walking surface 132 is flush with the surrounding ground area.

Figure 2:
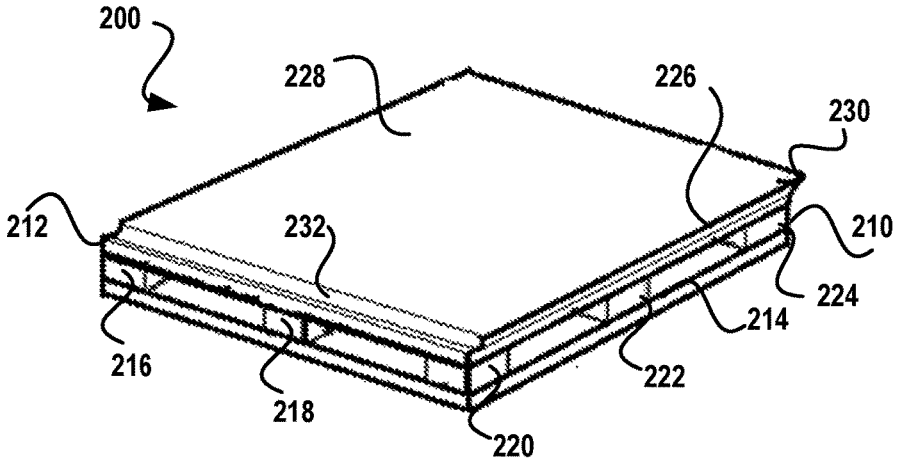
FIG. 2 is a perspective view of a splash pad module in accordance with the subject matter of this disclosure.

Referring now to FIG. 2 with continuing reference to the foregoing figure, there is shown in more detailed view a pallet assembly module, generally designated by the numeral 200. The pallet assembly module 200 is essentially identical to the pallet assembly modules 112-116 shown in FIG. 1.

The pallet assembly module 200 includes a pallet assembly 210 having an upper deck 212, a base 214, and a plurality of reinforcement members 216-224 positioned between the upper deck 212 and the base 214. In this exemplary embodiment, the upper deck 212 and the base 214 are essentially flat rectilinear sheets. The reinforcement members 216-224 are rectilinear tubes.

A water permeable layer 226 positioned over the pallet assembly upper deck 212 having a walking surface 228 thereon. The water permeable layer 226 includes an offset 230 on one end and a mating surface 232 on the other end to facilitate connection to an adjacent, identical module, as is illustrated by the pallet assembly modules 112-116 shown in FIG. 1. The dimensions of the offset 230 and the mating surface 232 are not critical, but, in this exemplary embodiment, the offset 230 and the mating surface 232 are about 1.5 inches wide.

The pallet assembly module 200 can be connected to adjacent pallet modules through conventional fastening mechanisms. The fastening mechanisms can be any suitable fastener, including head-style fasteners, drive-type fasteners, washer-type fasteners, nut-type fasters, screws, and bolts. The fastening mechanisms can include alternate joining methods, such as welding, crimping, taping, cementing, gluing or the use of other adhesives. Alternatively, the use of forces such as magnetic force or even frictional force can join the pallet assembly module 200 to other pallet assembly modules. In this exemplary embodiment, the pallet assembly module 200 connects to adjacent pallet assembly modules with screws.

The water permeable layer 226 forms a walking surface 228 that is a playground surface by coating an essentially flat planar sheet. The walking surface 228 can be roughened to facilitate traction to prevent users from slipping when the surface is wet. The water permeable layer 226 can be constructed from any suitable materials using any suitable manufacturing method. Suitable materials include ceramics, plastics, and/or composites.

Suitable plastic materials include thermoplastics, thermoset plastics, network polymers, rubbers, elastomers, and/or plastomers. In this exemplary embodiment, the water permeable layer 226 includes a coating formed from a plastic composite material. The plastic composite material can include a network polymer and a plastic binder material. The coating can be made from a pour-in-place plastic paving material provided by Porous Pave Inc. of Grant, Mich., which includes ground up recycled tire rubber in a plastic binder material. The coating can be applied to a recycled sports court tile.

In some embodiments, a heavy filler material, such as concrete, can be poured into one or more reinforcement members 216-224, so that the filled reinforcement members can serve as anchors for the amusement features 150-154 shown in FIG. 1.

Figure 3:
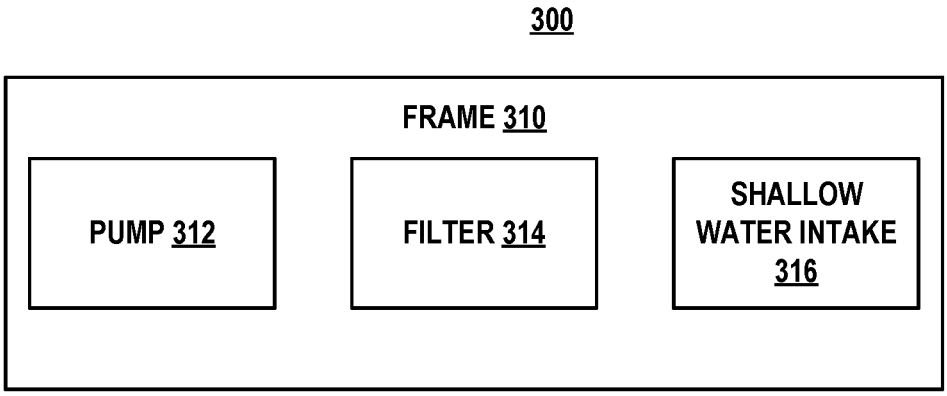
FIG. 3 is a block diagram of a pumping station for a portable water park in accordance with the subject matter of this disclosure.

Referring now to FIG. 3 with continuing reference to the foregoing figures, there is shown in more detailed view a pumping station, generally designated by the numeral 300. The pumping station 300 is essentially identical to the pumping station 146 shown in FIG. 1. The pumping station 300 includes a frame 310. A pump 312, a filter 314, and a shallow water intake 316 are mounted on the frame 310.

In operation, the pumping station 300 utilizes the shallow water intake 316 to draw water from a shallow recession, such as the shallow recession 118 shown in FIG. 1. The shallow water intake 316 is in fluid communication with the filter 314, which is in fluid communication with the pump 312. The pump 312 can drive the water from the shallow water intake 316 through the filter 314 to one or more tubular dispensers, such as the tubular dispensers 134-138 shown in FIG. 1.

Figure 4:
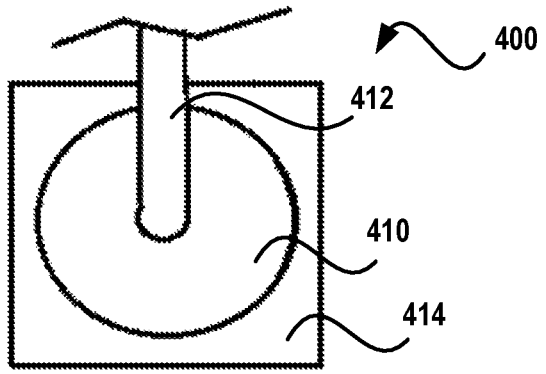
FIG. 4 is a fragmentary top plan view a shallow water intake device in accordance with the subject matter of this disclosure.
Figure 5:
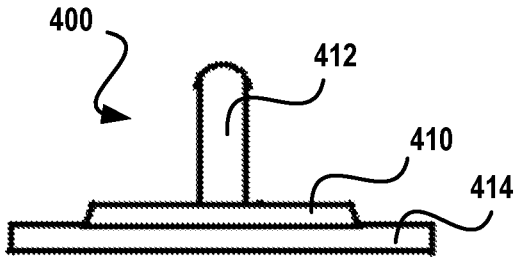
FIG. 5 is a front view of the shallow water intake device shown in FIG. 4 in accordance with the subject matter of this disclosure.
Figure 6:
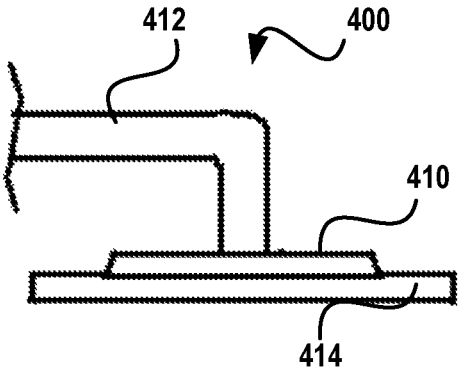
FIG. 6 is a fragmentary side view of the shallow water intake device shown in FIG. 4 in accordance with the subject matter of this disclosure.

Referring now to FIGS. 4-6 with continuing reference to the foregoing figures, there is shown in more detailed view a shallow water intake, generally designated by the numeral 400. The shallow water intake 400 is essentially identical to the shallow water intake 316 shown in FIG. 3.

The shallow water intake 400 includes a head 410 and a tubular connecting member 412. The head 410 is an essentially flat, essentially cylindrical tubular disc that is in fluid communication with the tubular connecting member 412. In this exemplary embodiment, the tubular connecting member 412 is a flexible tube that connects to a filter, such as the filter 314 shown in FIG. 3. The head 410 is positioned on an essentially flat grate 414 to facilitate the flow of water therethrough.

Figure 7:
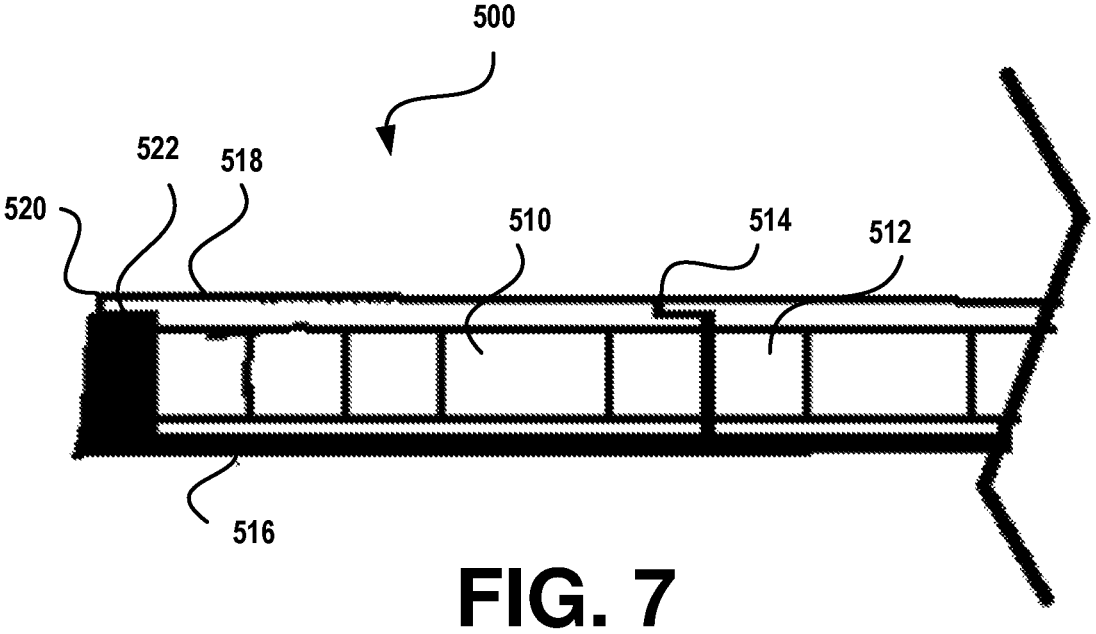
FIG. 7 is a fragmentary side view in cross section of another embodiment portable water park in accordance with the subject matter of this disclosure that is partially assembled.

Referring now to FIG. 7, there is shown another embodiment of a portable waterpark, generally designated by the numeral 500. The waterpark 500 is partially assembled because the waterpark 500 does not include tubular dispensers, the tubular dispensers 134-138 shown in FIG. 1, and amusement features, like the amusement features 150-154 shown in FIG. 1.

Like the embodiment shown in FIG. 1, the waterpark 500 is modular in design with a plurality of interlocking pallet assembly modules 510-512 that form a splash pad 514. The pallet assembly module 510 is a perimeter pallet module that has a smaller width than pallet assembly module 512, which is an interior pallet assembly module.

Unlike the embodiment shown in FIG. 1, the splash pad 514 is positioned within a raised tank 516 that sits upon the ground. As a result of the positioning of the splash pad 514 within the raised tank 516, an upper surface 518 of the splash pad 514 is positioned above-grade. An edge 520 of the pallet assembly module 510 extends over a side 522 of the raised tank 516.

Figure 8:
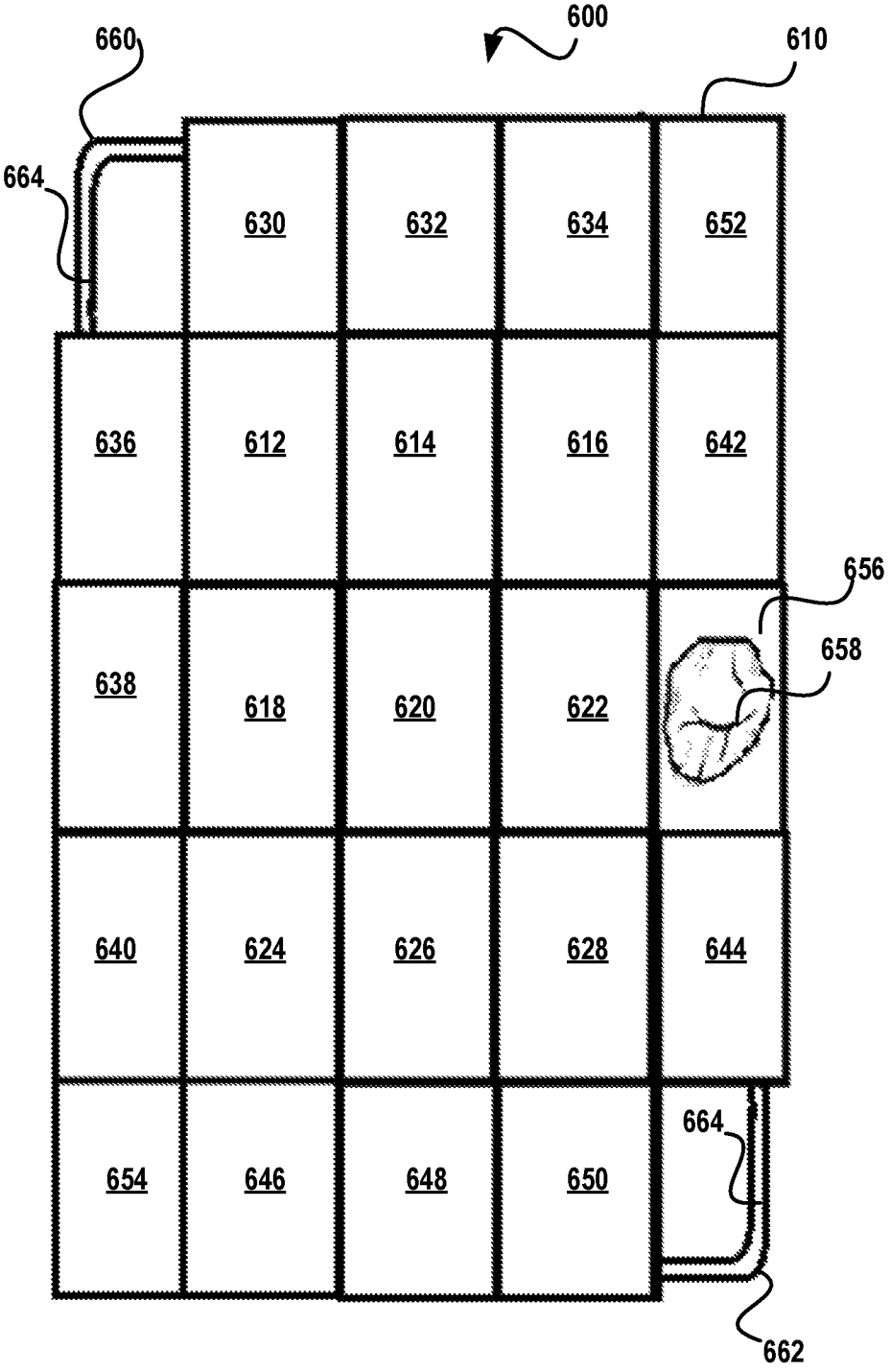
FIG. 8 is a top plan view of another embodiment of a portable water park in accordance with the subject matter of this disclosure that is partially assembled.

Referring now to FIG. 8, there is shown another embodiment of a portable waterpark, generally designated by the numeral 600. The portable waterpark 600 includes a splash pad 610. The splash pad 610 is formed from a plurality of interlocking pallet assembly modules 612-656 arranged in essentially rectangular configuration.

The pallet assembly modules 612-628 are interior pallet assembly modules. The pallet assembly modules 630-650 are perimeter pallet assembly modules. The pallet assembly modules 652-654 are corner pallet assembly modules. The pallet assembly module 656 is a perimeter pallet assembly module that includes an artificial rock 658 that conceals a pumping station, such as the pumping station 146 shown in FIG. 1. The interior pallet assembly modules have different dimensions than the perimeter pallet assembly modules and the corner pallet assembly modules, but embodiments are contemplated in which all of the pallet assembly modules 612-656 have the same dimensions.

The waterpark 600 is partially assembled because the waterpark 600 does not include tubular dispensers, the tubular dispensers 134-138 shown in FIG. 1, and amusement features, like the amusement features 150-154 shown in FIG. 1. Additionally, the corners 660-662 are not covered by corner pallet assembly modules to expose a tank 664 into which the splash pad 610 rests.

Like the embodiment shown in FIG. 1, the waterpark 500 is modular in design with a plurality of interlocking pallet assembly modules 510-512 that form a splash pad 514. The pallet assembly module 510 is a perimeter pallet module that has a smaller width than pallet assembly module 512, which is an interior pallet assembly module.

Unlike the embodiment shown in FIG. 1, the splash pad 514 is positioned within a raised tank 516 that sits upon the ground. As a result of the positioning of the splash pad 514 within the raised tank 516, an upper surface 518 of the splash pad 514 is positioned above-grade.

Figure 9:
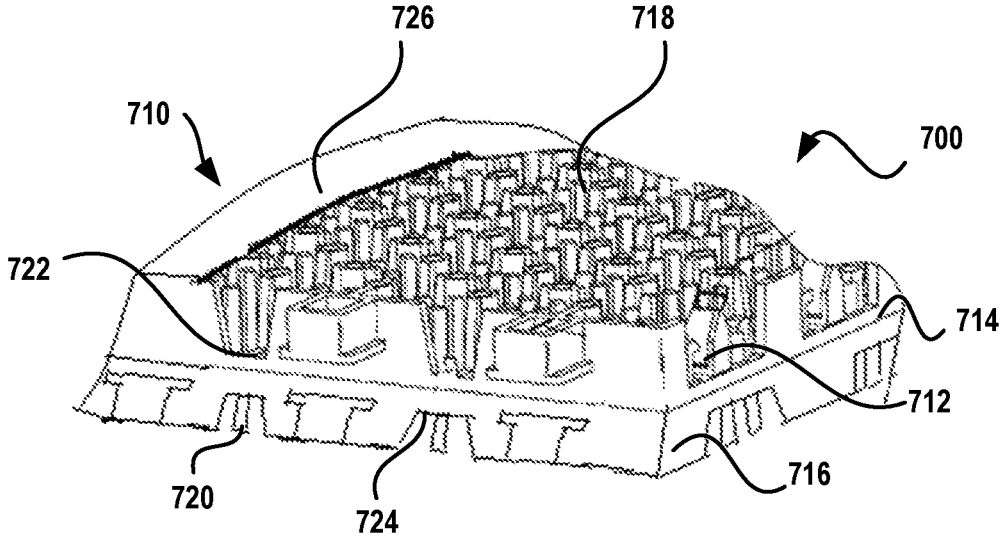
FIG. 9 is a fragmentary perspective view of an embodiment of a surface for, inter alia, a portable water park in accordance with the subject matter of this disclosure that is partially assembled.

Referring now to FIG. 9 with continuing reference to the foregoing figures, there is shown in more detailed view of an interlocking tile, generally designated by the numeral 700, that can be used to form a wear resistant walking surface 710. The walking surface 710 is suitable for playgrounds, running tracks, and waterparks, such as the waterpark 100 shown in FIG. 1. Specifically, the walking surface 710 can be used in place of the walking surface 132 shown in FIG. 1. The tile 700 can be a modified sports court tile.

The interlocking tile 700 has a layered structure that includes an upper layer 712, a middle layer 714, and a lower layer 716. The middle layer 714 is an essentially planar support substrate. The upper layer 712 and the lower layer 716 include a plurality of projections 718-720 that extend outwardly from essentially flat surfaces 722-724 on either side of the middle layer 714.

The projections 718-720 can be made of the same material as the middle layer 714. In some embodiments, the projections 718-720 and the middle layer 714 are integral. In other embodiments, the projections 718-720 and the middle layer 714 are unitary.

A coating 726 can be applied to the upper layer 712 to cover the projections 718 completely. The coating 726 can be made of similar material as is used to form the water permeable layer 226 shown in FIG. 2. In this exemplary embodiment, the projections 718 are made from plastic materials that are harder than the materials that are used to form the coating 726, which provides a walking surface 710 that is more wear resistant than the water permeable layer 226. The use of projections 718 is more economically efficient because the projections 718 last longer than the coating 726, so that less coating material is used over time.

The projections 718-720 and the middle layer 714 can be made from a rigid material, which has a higher Young's modulus than the materials that are used to form the coating 726. The projections 718-720 and the middle layer 714 can be made from a rigid plastic, which can be thermoplastics, thermoset plastics, network polymers, rubbers, elastomers, and/or plastomers. The coating 726 can be made from plastic material, including plastic composite materials. Suitable plastic composite materials include a network polymer and a plastic binder material.

Figure 10:
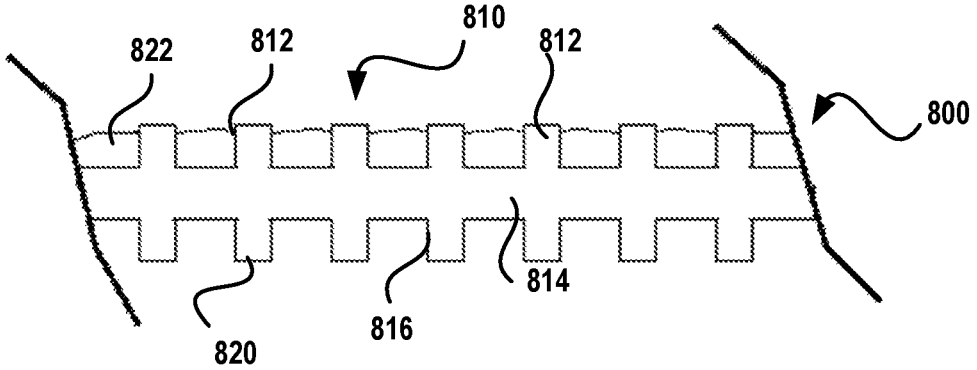
FIG. 10 is a fragmentary schematic diagram of another embodiment of a surface for, inter alia, a portable water park in accordance with the subject matter of this disclosure that is partially assembled.

Referring now to FIG. 10 with continuing reference to the foregoing figures, there is shown in more detailed view of another interlocking tile, generally designated by the numeral 800, that can be used to form a wear resistant surface 810. The wear resistant surface 810 is suitable for playgrounds, running tracks, and waterparks, such as the waterpark 100 shown in FIG. 1, like the wear resistant surface 710 shown in FIG. 9. The tile 800 can be a modified sports court tile.

Like the embodiment shown in FIG. 9, the interlocking tile 800 includes an upper layer 812, a middle layer 814, and a lower layer 816. A plurality of projections 818-820 project outwardly from the upper layer 812 and the lower layer 816. In this exemplary embodiment, the projections 818-820 are pins having rounded heads.

The upper layer 812 includes coating material 822. Unlike the embodiment shown in FIG. 9, the coating material 822 does not cover the projections 818 entirely. The projections 818 provide the coating material 822 with additional durability because the projections 818 are made from material that is harder than the coating material 822.

Figure 11:
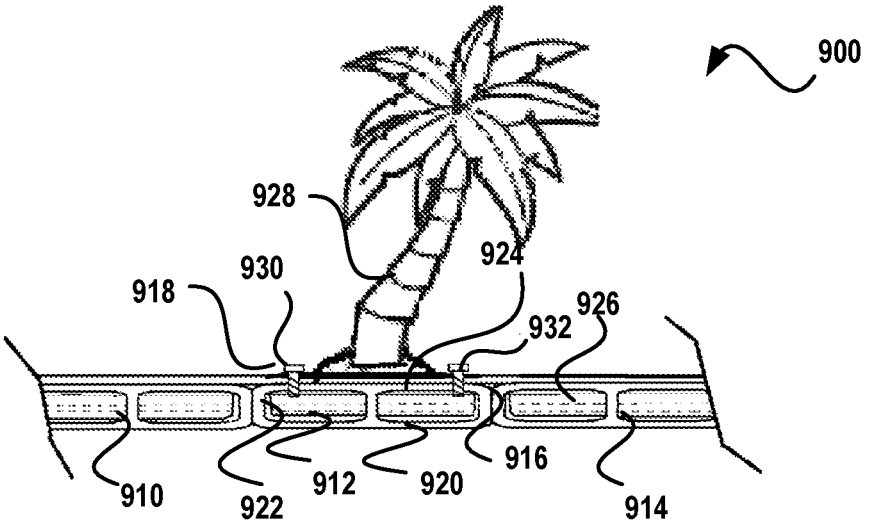
FIG. 11 is a fragmentary schematic diagram of another embodiment of a portable water park in accordance with the subject matter of this disclosure.

Referring now to FIG. 11, there is shown a section, generally designated by the numeral 900, of another embodiment of a portable waterpark. The waterpark section 900 includes three modules 910-914. In this exemplary embodiment, the modules 910-914 can be plastic pallets.

The module 912 includes a plurality of walls 916, an upper layer 918, and a lower layer 920. The walls 916, the upper layer 918, and the lower layer 920 define an inner chamber 922 that can be filled with an agglomerating material, such as concrete, to form a cell 924. The modules 910 and 914 can have a similar structure.

A plurality of connectors 926 can extend through the cell 924 to connect the modules 910-914 to one another to form a base for an amusement feature 928. In this exemplary embodiment, the connectors 926 include rods positioned within tubes.

The amusement feature 928 can be attached to the cell 924 with fasteners 930-932. In this exemplary embodiment, the fasteners 930-932 are metal bolts.

Figure 12:
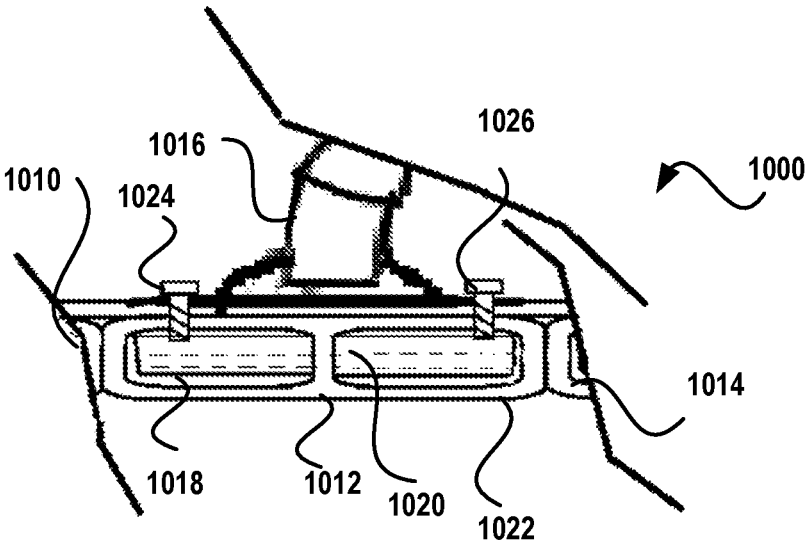
FIG. 12 is a fragmentary schematic diagram of another embodiment of a portable water park in accordance with the subject matter of this disclosure.

Referring now to FIG. 12, there is shown a section, generally designated by the numeral 1000, of another embodiment of a portable waterpark. The waterpark section 1000 includes three modules 1010-1014. The modules 1010-1014 support an amusement feature 1016.

Like the embodiment shown in FIG. 11, a rod 1018 extends through the modules 1010-1014. Unlike the embodiment shown in FIG. 11, each of the modules 1010-1014 includes a pan 1020 that can hold concrete that can form a layer 1022 for anchoring the amusement feature 1016. The amusement feature 1016 can be attached to the concrete layer 1022 with the fasteners 1024-1026.

Figure 13:
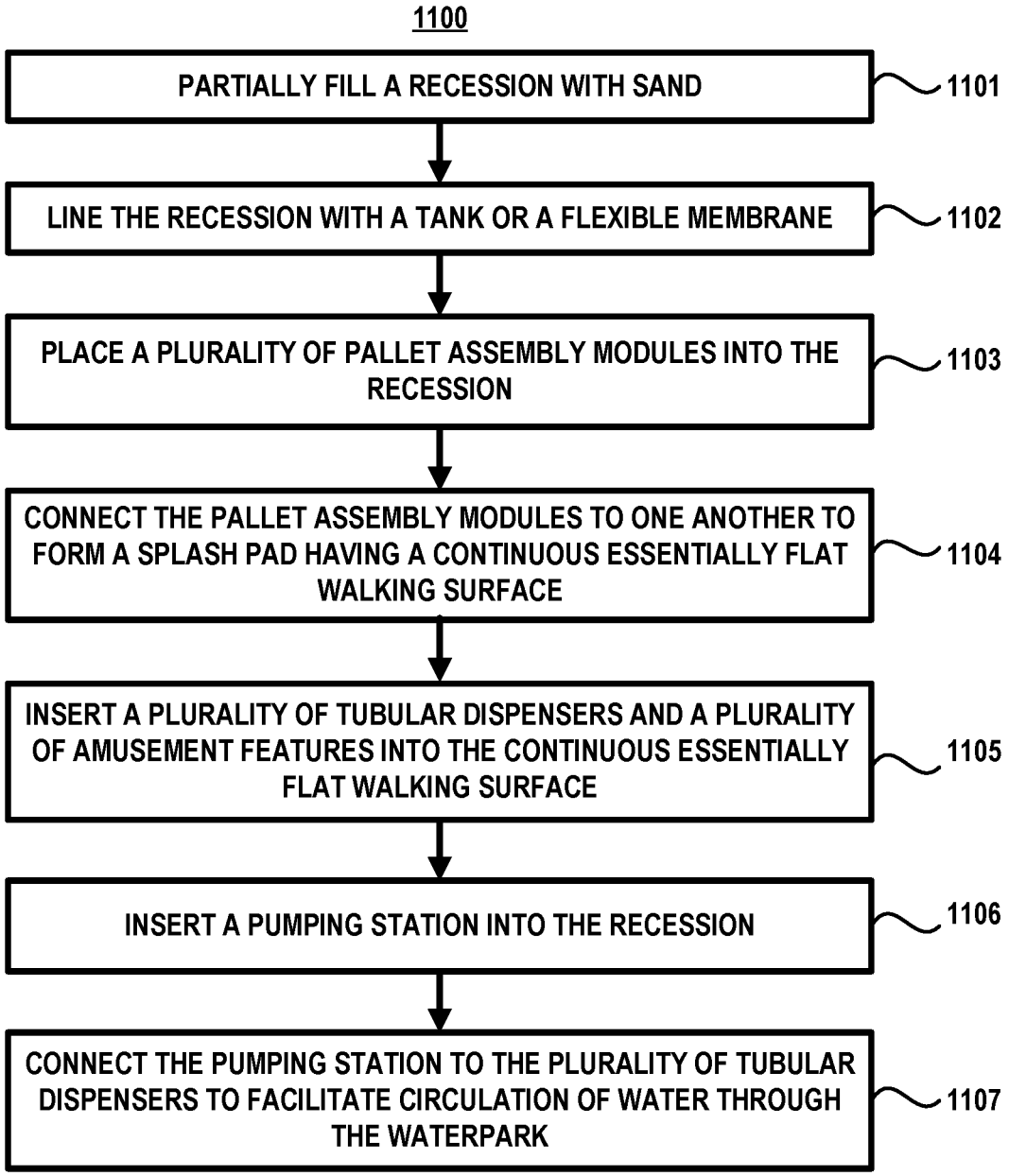
FIG. 13 is an exemplary process in accordance with the subject disclosure.

Referring now to FIG. 13 with continuing reference to the foregoing figures, an exemplary method, generally designated with the numeral 1100, for assembling a portable waterpark is shown. The method 1100 can be performed to assemble the portable waterpark 100 shown in FIG. 1.

At 1101, a recession is partially filled with sand. In this exemplary embodiment, the recession can be the recession 118 shown in FIG. 1. The sand can be the sand from the sand layer 158 shown in FIG. 1. Step 701 can be omitted in embodiments in which the portable waterpark is not assembled within a recession.

At 1102, the recession is lined with a tank or a membrane. In this exemplary embodiment, the tank can be the tank 156 shown in FIG. 1. Step 702 can be omitted in embodiments in which the portable waterpark is not assembled within a recession.

At 1103, a plurality of pallet assembly modules is placed into the recession. In this exemplary embodiment, the pallet assembly modules can be the pallet assembly modules 112-116 shown in FIG. 1 and/or the pallet assembly module 200 shown in FIG. 2. In embodiments in which the portable waterpark is not assembled within a recession, the plurality of pallet assembly modules is placed on the ground in Step 703.

At 1104, the pallet assembly modules are connected to one another to form a splash pad having a continuous essentially flat walking surface. In this exemplary embodiment, the splash pad can be the splash pad 110 shown in FIG. 1. The walking surface can be the continuous water permeable walking surface 132 shown in FIG. 1 and/or the walking surface 228 shown in FIG. 2.

At 1105, a plurality of tubular dispensers and a plurality of amusement features are inserted into the continuous essentially flat walking surface. In this exemplary embodiment, the tubular dispensers can be the tubular dispensers 134-138 shown in FIG. 1. The amusement features can be the amusement features 150-154 shown in FIG. 1.

At 1106, a pumping station is inserted into the recession. In this exemplary embodiment, the pumping station can be the pumping station 146 shown in FIG. 1 and/or the pumping station 300 shown in FIG. 3.

At 1107, the pumping station is connected to the plurality of tubular dispensers to facilitate circulation of water through the waterpark. The water is circulated through the pumping station to the tubular dispensers onto an upper surface of the splash pad. Then, the water permeates through the splash pad to collect in the recession for recirculation through the portable waterpark.

Figure 14:
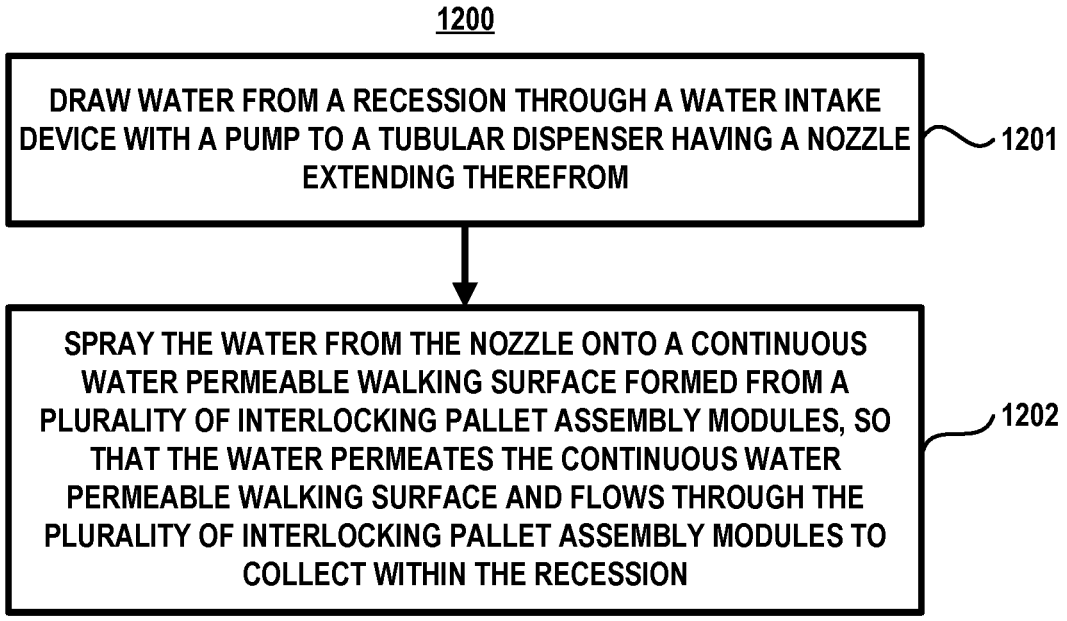
FIG. 14 is another exemplary process in accordance with the subject disclosure.

Referring now to FIG. 14 with continuing reference to the foregoing figures, an exemplary method, generally designated with the numeral 1200, for circulating water through a waterpark is shown. The method 1200 can be performed with the portable waterpark 100 shown in FIG. 1.

At 1201, water is drawn from a recession through a water intake device with a pump to a tubular dispenser having a nozzle extending therefrom. In this exemplary embodiment, the water intake device can be the shallow water intake 316 shown in FIG. 3 and/or the shallow water intake device 400 shown in FIGS. 4-6. The pump can be the pump 312 shown in FIG. 2. The tubular dispenser can be one or more of the tubular dispensers 134-138 shown in FIG. 1. The nozzle can be one or more of the nozzles 140-144 shown in FIG. 1.

At 1202, the water is sprayed from the nozzle onto a continuous water permeable walking surface formed from a plurality of interlocking pallet assembly modules, so that the water permeates the continuous water permeable walking surface and flows through the plurality of interlocking pallet assembly modules to collect within the recession. In this exemplary embodiment, the continuous water permeable walking surface can be the continuous water permeable walking surface 132 shown in FIG. 1 and/or the walking surface 228 shown in FIG. 2. The pallet assembly modules can be the pallet assembly modules 112-116 shown in FIG. 1 and/or the pallet assembly module 200 shown in FIG. 2. The recession can be the recession 118 shown in FIG. 1.

Supported Features and Embodiments

The detailed description provided above in connection with the appended drawings explicitly describes and supports various features of a portable water park and methods for circulating water through the portable water park. By way of illustration and not limitation, supported embodiments include a module for a water amusement device comprising: a pallet assembly having an upper deck, a base, and at least one reinforcement member positioned between the upper deck and the base, and a water permeable layer positioned over the pallet assembly upper deck having a walking surface thereon.

Supported embodiments include the foregoing module, wherein the pallet assembly is a plastic pallet assembly.

Supported embodiments include any of the foregoing modules, wherein the water permeable layer includes a plastic composite material.

Supported embodiments include any of the foregoing modules, wherein the plastic composite material includes a network polymer and a plastic binder material.

Supported embodiments include any of the foregoing modules, wherein the water permeable layer has an offset on one end and a mating surface on the other end to facilitate connection to an adjacent, identical module.

Supported embodiments include any of the foregoing modules, wherein the reinforcement member includes a tubular portion.

Supported embodiments include any of the foregoing modules, wherein the tubular portion is filled with a material for anchoring an amusement feature on the water permeable layer.

Supported embodiments include a kit, a method, an apparatus, and/or means for implementing any of the foregoing modules or a portion thereof.

Supported embodiments include a module for a water amusement device comprising: a plastic substructure having an upper deck, a base, and at least one reinforcement member positioned between the upper deck and the base, and a water permeable layer positioned over the plastic substructure upper deck having a walking surface thereon.

Supported embodiments include a portable waterpark comprising: a splash pad having a plurality of interlocking pallet assembly modules with each pallet assembly module having a supporting body and a water permeable layer and each water permeable layer connects to at least one adjacent water permeable layer to form a continuous water permeable walking surface, at least one tubular dispenser having at least one nozzle extending through the splash pad continuous water permeable walking surface, a pumping station having at least one pump and at least one water intake device, wherein the splash pad, the tubular dispenser, and the pumping station inserts into a recession having water therein; and wherein the water intake device provides water from the recession to the at least one pump, so that the pump can drive water through the tubular dispenser to project through the nozzle onto the splash pad continuous water permeable walking surface.

Supported embodiments include the foregoing portable waterpark, wherein the pumping station includes a filter positioned between the at least one pump and the at least one water intake device.

Supported embodiments include any of the foregoing portable waterparks, wherein the tubular dispenser is a fountain.

Supported embodiments include any of the foregoing portable waterparks, further comprising: a shallow tank defining the recession.

Supported embodiments include any of the foregoing portable waterparks, further comprising: a non-permeable membrane lining the recession.

Supported embodiments include any of the foregoing portable waterparks, wherein each pallet assembly module includes a plastic pallet assembly.

Supported embodiments include any of the foregoing portable waterparks wherein each water permeable layer includes a plastic composite material.

Supported embodiments include any of the foregoing portable waterparks, wherein the plastic composite material includes a network polymer and a plastic binder material.

Supported embodiments include any of the foregoing portable waterparks, wherein each water permeable layer has an offset on one end and a mating surface on the other end to facilitate connection to an adjacent, identical pallet assembly module.

Supported embodiments include any of the foregoing portable waterparks, further comprising: a plurality of amusement features positioned on the splash pad continuous water permeable walking surface.

Supported embodiments include any of the foregoing portable waterparks, wherein each of the plurality of amusement features is anchored to one of the pallet assembly modules.

Supported embodiments include any of the foregoing portable waterparks, wherein the pallet assembly modules include interior pallet assembly modules, perimeter pallet assembly modules, and corner pallet assembly modules.

Supported embodiments include any of the foregoing portable waterparks, wherein the water intake device is a shallow water intake.

Supported embodiments include any of the foregoing portable waterparks, wherein the shallow water intake includes an essentially flat, essentially cylindrical, tubular head for inserting into water, and a tubular connecting member in fluid communication with the at least one pump, wherein the essentially flat, essentially cylindrical, tubular head connects to the tubular connecting member so that the at least one pump can draw water into the essentially flat, essentially cylindrical, tubular head through the tubular connecting member.

Supported embodiments include any of the foregoing portable waterparks, wherein the essentially flat, essentially cylindrical, tubular head is disc-shaped.

Supported embodiments include any of the foregoing portable waterparks, wherein the essentially flat, essentially cylindrical, tubular head include an opening and an essentially flat grate is positioned at the opening.

Supported embodiments include an apparatus, a kit, a method, a system, and/or means for implementing any of the foregoing portable waterparks or a portion thereof.

Supported embodiments include a method for circulating water through a portable waterpark, the method comprising: drawing the water from a recession through a water intake device with a pump to a tubular dispenser having a nozzle extending therefrom, and spraying the water from the nozzle onto a continuous water permeable walking surface formed from a plurality of interlocking pallet assembly modules, so that the water permeates the continuous water permeable walking surface and flows through the plurality of interlocking pallet assembly modules to collect within the recession.

Supported embodiments include the foregoing method, wherein a shallow tank defines the recession.

Supported embodiments include any of the foregoing methods, wherein a non-permeable membrane lines the recession.

Supported embodiments include any of the foregoing methods, further comprising: positioning a plurality of amusement features on the splash pad continuous water permeable walking surface.

Supported embodiments include any of the foregoing methods, further comprising: anchoring a plurality of amusement features to the plurality of interlocking pallet assembly modules.

Supported embodiments include an apparatus, a kit, a system, and/or means for implementing any of the foregoing methods or a portion thereof.

Supported embodiments include a shallow water intake for coupling to a pump in a portable waterpark having a pumping station with the pump, the shallow water intake comprising: an essentially flat, essentially cylindrical, tubular head for inserting into water, and a tubular connecting member in fluid communication with the pump, wherein the essentially flat, essentially cylindrical, tubular head connects to the tubular connecting member so that the pump can draw water into the essentially flat, essentially cylindrical, tubular head through the tubular connecting member.

Supported embodiments include the foregoing shallow water intake, wherein the essentially flat, essentially cylindrical, tubular head is disc-shaped.

Supported embodiments include any of the foregoing shallow water intakes, wherein the essentially flat, essentially cylindrical, tubular head include an opening and an essentially flat grate is positioned at the opening.

Supported embodiments include a kit, a method, an apparatus, and/or means for implementing any of the foregoing shallow water intakes or a portion thereof.

Supported embodiments include a walking surface comprising: an interlocking tile having an upper layer, a lower layer, and a middle layer, the middle layer include an essentially planar substrate with a plurality of projections that extend through the upper layer and the lower layer, and coating material that is positioned in the upper layer between the projections, wherein the projections are harder than the coating material.

Supported embodiments include the foregoing walking surface, wherein the substrate and the projections are integral.

Supported embodiments include any of the foregoing walking surfaces, wherein the substrate and the projections are unitary.

Supported embodiments include any of the foregoing walking surfaces, wherein the coating material covers the projections, at least partially.

Supported embodiments include any of the foregoing walking surfaces, wherein the substrate and the projections are rigid.

Supported embodiments include any of the foregoing walking surfaces, wherein the substrate is plastic.

Supported embodiments include any of the foregoing walking surfaces, wherein the coating material includes a plastic composite material.

Supported embodiments include any of the foregoing walking surfaces, wherein the plastic composite material includes a network polymer and a plastic binder material.

Supported embodiments include a kit, a method, an apparatus, and/or means for implementing any of the foregoing walking surfaces or a portion thereof.

Supported embodiments include a portable waterpark comprising: a splash pad having a plurality of interlocking pallet assembly modules with at least two pallet assembly modules having an upper layer, a lower layer, and a plurality of walls defining a chamber, a connector for connecting the at least two pallet assembly modules, an amusement feature projecting upwardly from one of the at least two pallet assembly modules, and a cell positioned within the chamber forming an anchor to hold the amusement feature in place.

Supported embodiments include the foregoing portable waterpark, wherein the cell is made from a first material, and the interlocking pallet assembly modules are made from a second material, wherein the first material has a higher density than the second material.

Supported embodiments include any of the foregoing portable waterparks, wherein the first material is an agglomerating material.

Supported embodiments include any of the foregoing portable waterparks, wherein the agglomerating material is concrete.

Supported embodiments include any of the foregoing portable waterparks, wherein the chamber includes a pan for holding the cell.

Supported embodiments include any of the foregoing portable waterparks, wherein the connector is a tube having a rod therein.

Supported embodiments include a kit, a method, an apparatus, and/or means for implementing any of the foregoing portable waterparks or a portion thereof.

Supported embodiments include an anchor for an amusement feature for a portable waterpark, the anchor comprising: a pallet assembly modules having an upper layer, a lower layer, and a plurality of walls defining a chamber, a concrete cell positioned within the chamber, wherein the amusement feature can connect to the concrete cell.

Supported embodiments include the foregoing anchor, further comprising: a connector for connecting to an adjacent pallet assembly module Supported embodiments include any of the foregoing anchors, wherein the connector is a tube having a rod therein.

Supported embodiments include a kit, a method, an apparatus, and/or means for implementing any of the foregoing anchors or a portion thereof.

Supported embodiments can provide various attendant and/or technical advantages in terms of a modular, portable water park that requires minimal construction, is affordable, and can be constructed of materials that include about 95% recycled content.

Supported embodiments include a modular, portable water park that does not require a massive concrete water tank and that can utilize unused box stores or mall spaces.

Supported embodiments include a modular, portable water park that can be suitable for all ages that have a substantially reduced risk of bodily injury and/or drowning. Such modular, portable waterparks require minimal staffing.

Supported embodiments include a modular, portable water park that eliminates conventional drains that can become clogged by leaves.

Supported embodiments include a modular, portable water park that can be implemented with no excavation.

The detailed description provided above in connection with the appended drawings is intended as a description of examples and is not intended to represent the only forms in which the present examples can be constructed or utilized.

It is to be understood that the configurations and/or approaches described herein are exemplary in nature, and that the described embodiments, implementations and/or examples are not to be considered in a limiting sense, because numerous variations are possible. For example, the disclosed modular structure implemented as a restaurant patio that can be used to collect rainwater for agricultural or other similar applications.

The specific processes or methods described herein can represent one or more of any number of processing strategies. As such, various operations illustrated and/or described can be performed in the sequence illustrated and/or described, in other sequences, in parallel, or omitted. Likewise, the order of the above-described processes can be changed.

Although the subject matter has been described in language specific to structural features and/or methodological acts, it is to be understood that the subject matter defined in the appended claims is not necessarily limited to the specific features or acts described above. Rather, the specific features and acts described above are presented as example forms of implementing the claims.

What is claimed is:

1. A portable waterpark comprising:

a recreational splash pad having a plurality of interlocking pallet assembly modules with each pallet assembly module having a supporting body and a water permeable layer and each water permeable layer connects to at least one adjacent water permeable layer to form a continuous water permeable walking surface, at least one tubular dispenser having at least one nozzle extending through the recreational splash pad continuous water permeable walking surface, and a pumping station having at least one pump and at least one water intake device, wherein each pallet assembly module body includes an upper deck, a base, and a plurality of spaced-apart reinforcement members positioned between the upper deck and the base to separate the upper deck from the base forming an open structure therein, wherein the recreational splash pad, the tubular dispenser, and the pumping station inserts into a recession having water therein, wherein the recession is lined with a removable, flexible membrane material defining a water repository positioned below the continuous water permeable walking surface, and wherein the water intake device provides water from the recession to the at least one pump, so that the pump can drive water through the tubular dispenser to project through the nozzle onto the recreational splash pad continuous water permeable walking surface.

2. The portable waterpark of claim 1, wherein the deck and the base are essentially flat rectilinear sheets.

3. The portable waterpark of claim 2, wherein the reinforcement members are rectilinear tubes.

4. The portable waterpark of claim 1, wherein the pumping station includes a filter positioned between the at least one pump and the at least one water intake device.

5. The portable waterpark of claim 1, wherein the tubular dispenser is a water spouting amusement feature.

6. The portable waterpark of claim 1, wherein each pallet assembly module includes a plastic pallet assembly.

7. The portable waterpark of claim 1, wherein each water permeable layer includes a plastic composite material that includes a network polymer and a plastic binder material.

8. The portable waterpark of claim 1, wherein each water permeable layer has an offset on one end and a mating surface on the other end to facilitate connection to an adjacent, identical pallet assembly module.

9. The portable waterpark of claim 1, further comprising:

a plurality of amusement features positioned on the recreational splash pad continuous water permeable walking surface.

10. The portable waterpark of claim 9, wherein each of the plurality of amusement features is anchored to one of the pallet assembly modules.

11. The portable waterpark of claim 1, wherein the pallet assembly modules include interior pallet assembly modules, perimeter pallet assembly modules, and corner pallet assembly modules.

* * * * *